US010724309B2

(12) United States Patent
Mathis

(10) Patent No.: US 10,724,309 B2
(45) Date of Patent: Jul. 28, 2020

(54) WELLBORE CEMENT MANAGEMENT SYSTEM

(71) Applicant: NeoDrill AS, Stavanger (NO)

(72) Inventor: Wolfgang Mathis, Sandnes (NO)

(73) Assignee: NeoDrill AS, Stavanger (NO)

( * ) Notice: Subject to any disclaimer, the term of this patent is extended or adjusted under 35 U.S.C. 154(b) by 173 days.

(21) Appl. No.: 15/880,571

(22) Filed: Jan. 26, 2018

(65) Prior Publication Data

US 2018/0223622 A1 Aug. 9, 2018

Related U.S. Application Data

(60) Provisional application No. 62/455,671, filed on Feb. 7, 2017.

(51) Int. Cl.

| | |
|---|---|
| ***E21B 19/00*** | (2006.01) |
| ***E21B 17/10*** | (2006.01) |
| ***E21B 33/14*** | (2006.01) |
| ***E21B 41/08*** | (2006.01) |
| ***E21B 15/00*** | (2006.01) |
| ***E21B 19/08*** | (2006.01) |
| ***E21B 19/24*** | (2006.01) |

(52) U.S. Cl.

CPC ..... *E21B 19/002* (2013.01); *E21B 15/006* (2013.01); *E21B 17/1078* (2013.01); *E21B 19/08* (2013.01); *E21B 19/24* (2013.01); *E21B 33/14* (2013.01); *E21B 33/143* (2013.01); *E21B 41/08* (2013.01)

(58) Field of Classification Search

CPC ..... E21B 19/002; E21B 19/08; E21B 19/24; E21B 33/14; E21B 33/143; E21B 41/08

See application file for complete search history.

(56) References Cited

U.S. PATENT DOCUMENTS

| | | | | |
|---|---|---|---|---|
| 3,426,844 | A | 2/1969 | McDaniel | |
| 3,459,259 | A | 8/1969 | Matthews | |
| 3,732,143 | A | 5/1973 | Joosse | |
| 2003/0029620 | A1 | 2/2003 | Strand | |
| 2014/0374113 | A1 | 12/2014 | Kebadze | |
| 2017/0183934 | A1 * | 6/2017 | Mathis | E21B 33/035 |

FOREIGN PATENT DOCUMENTS

| | | | | |
|---|---|---|---|---|
| GB | 2239471 A | * | 7/1991 | E21B 33/035 |
| GB | 2239471 A | | 7/1991 | |
| WO | 20150126259 A1 | | 8/2015 | |
| WO | WO-2015126259 A1 | * | 8/2015 | |

OTHER PUBLICATIONS

International Search Report and Written Opinion—International Application No. PCT/IB2018/050481.

* cited by examiner

*Primary Examiner* — David Carroll
(74) *Attorney, Agent, or Firm* — Richard A. Fagin

(57) ABSTRACT

A well cement management system includes a well support base for urging below a bottom of a body of water, a wellbore tubular component disposed through the well support base; and a filling medium top up line in fluid communication with a space defined by an interior of the wellbore tubular component.

13 Claims, 11 Drawing Sheets

WELLBORE CEMENT MANAGEMENT SYSTEM

CROSS REFERENCE TO RELATED APPLICATIONS

Priority is claimed from U.S. Provisional Application No. 62/445,671 filed on Feb. 7, 2017, which application is incorporated herein by reference in its entirely.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of support structures for subsea wellbores that may extend from below the bottom of a body of water to above the bottom of a body of water.

International Patent Application Publication No. WO 2015/054766 A1 describes a process for installing an integral assembly, comprising a first penetration step that takes place by means of the weight itself of the assembly, and a second penetration step that takes place by suction for completing the penetration of the assembly into the sea floor. Additionally, the foregoing publication discloses an integral assembly itself having particularly one or more suction piles associated to one or more wellbore tubular components.

International Patent Application Publication No. WO 2016/085348 A1 describes a device for reducing the load on a wellhead casing from a bending moment generated by a horizontal load component from a well element arranged over a wellhead. The device includes a supporting frame component (6) which is connected to an upper portion of the wellhead casing and projects outwards from the center axis of the wellhead casing. The device also includes an abutment which rests supportingly against a base (13, 41) at a radial distance from the wellhead casing. The supporting frame is arranged to absorb a portion of the bending moment.

Mounting parts of the well structure directly into the supporting structure has issues of interest, such as hot work (such as but not limited to welding) when fabricating the construction. Hot work on the well structure can cause heat induced stresses and may introduce potential weak spots with respect to fatigue life capacity. It therefore may be advantageous to prevent hot work in areas with high load exposure to be able to keep the high mechanical specifications of the well structure.

DETAILED DESCRIPTION

Figure 1:
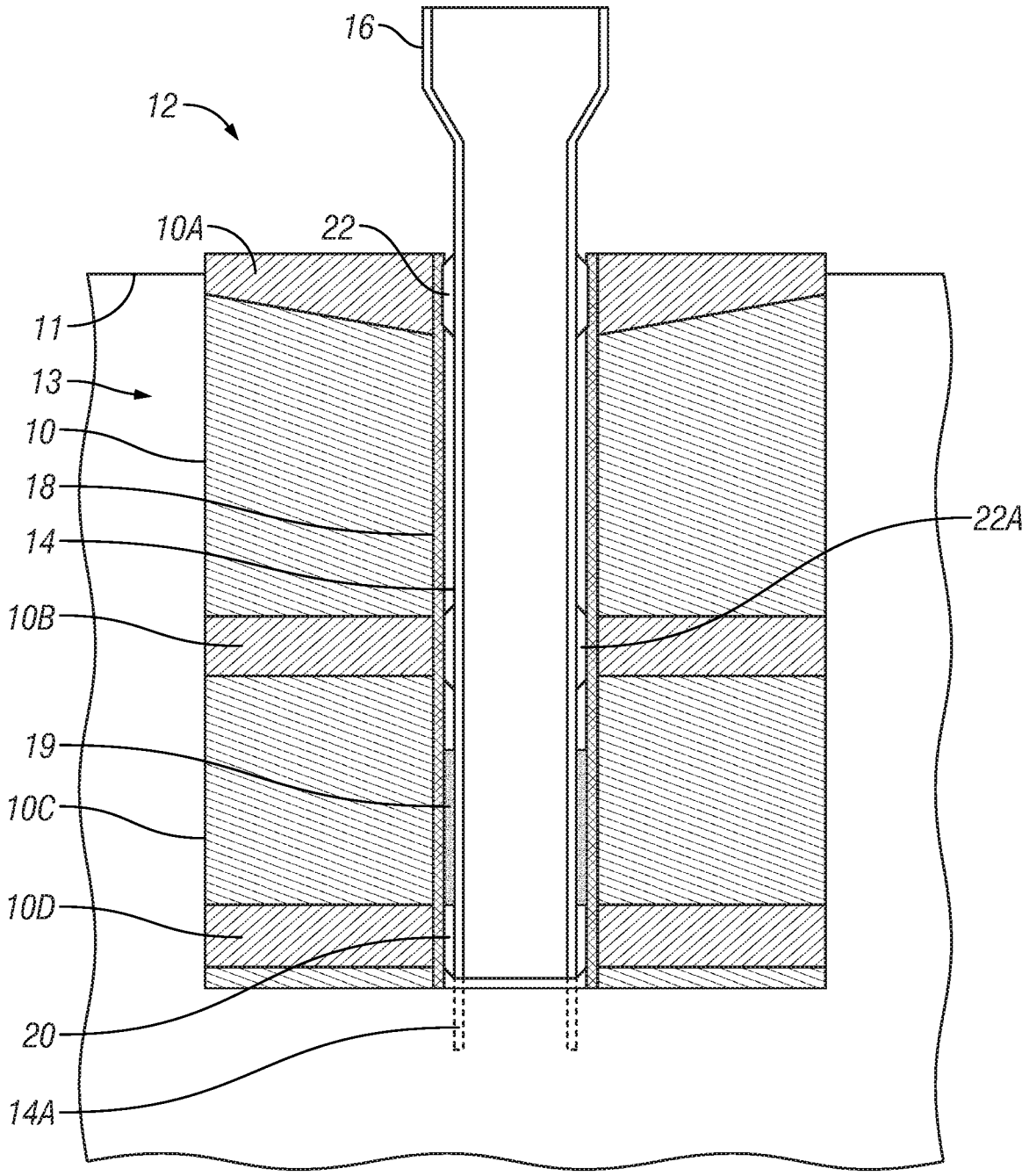
FIG. 1 shows one embodiment of a well support structure according to the present disclosure.

An example embodiment of a well support structure is shown in FIG. 1. The support structure may comprise a well support base 10 such as a suction anchor or piling that may be partially urged into sediments 13 below the water bottom 12. The well support base 10 may in some embodiments comprise one or more guide tube(s) 18 extending from an upper end of the well support base 10 toward or beyond a lower end of the well support base 10. The present example embodiment of the well support base may include an outer wall 10C that defines an enclosed space within the perimeter of the outer wall 10C. Other embodiments of the well support base may not have an enclosed space inside the outer wall 10C.

A top 10A of the well support base 10 may form one of, and the well support base 10 may have one or more support elements 10B/10D attached to the well support base 10 at selected longitudinal positions below the top 10A to support the guide tube(s) 18. In some embodiments, the guide tube 18 may be omitted and the top 10A and one or more supports 10B, 10D may support a wellbore tubular component 14 directly or through an intermediate device such as a centralizer or the like.

The wellbore tubular component 14 in the present embodiment may extend through the guide tube 18. The wellbore tubular component 14 may be, for example, a low pressure wellhead housing, a conductor pipe, a high pressure wellhead housing, a surface casing or any other wellbore tubular component that extends and protrudes through the top 10A of the well support base 10. The wellbore tubular component 14 and/or the guide pipe 18 may stop within or extend beyond the well support base 10, and/or may be extendable by different means. The wellbore tubular component 14 and/or the guide pipe 18 may be straight as shown in FIG. 1, or they may be curved (not shown in FIG. 1.) to allow for shallow kick-off for deviated well drilling. In the present embodiment, a first load transfer device, which may be a first centralizer 22 may be positioned proximate the upper end of the guide tube 18. The first centralizer 22 may support the wellbore tubular component 14 laterally within the guide tube 18. The vertical position of the first centralizer 22 may define a first support level (L1 in FIG. 2). A second centralizer 22A may support the wellbore tubular component 14 laterally within the guide tube 18 further down axially from the upper end of the guide tube 18. The vertical position of the second centralizer 22A may define a second support level (L2 in FIG. 2). At the first support level (L1 in FIG. 2), the first centralizer 22 may support the wellbore tubular component 14 in both lateral directions (33, 34 in FIG. 4) perpendicular to the longitudinal axis (32 in FIG. 4) of the guide tube 18. Rotational support against the torsional moment Mt 31 of the wellbore tubular component 14 is provided by an anchor 20 and is indicated as 31B in FIG. 4.

In the present embodiment, a lower end of the wellbore tubular component 14 may be attached to the guide tube 18 using the anchor 20. The anchor 20 may be affixed to the guide tube 18, for example, by welding. Because the bottom of the guide tube 18 does not experience large bending moment as a result of stresses applied to the upper end of the wellbore tubular component 14, e.g., a low pressure housing 16, welding may be used to attach the anchor 20 without materially affecting the fatigue life of the system.

Figure 4:
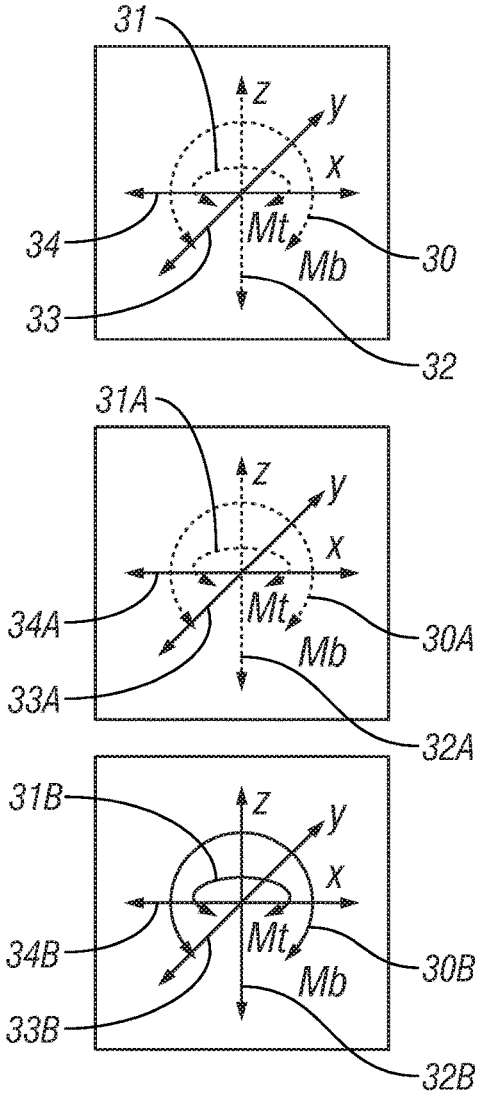

With reference to FIG. 4, lateral 33B, 34B, axial 32B, rotational 30B and torsional 31B fixing of the wellbore tubular component 14 at a third support level (L3 in FIG. 2) of the anchor (20 in FIG. 1) is shown in FIG. 4 as indicated. At the first support level (L1 in FIG. 2), no welding is required to support the wellbore tubular component (14 in FIG. 1) in the guide tube (18 in FIG. 1), thus at the first support level (L1 in FIG. 2) no reduction in the structural integrity or fatigue life of the wellbore tubular component (14 in FIG. 1), the well support base (10 in FIG. 1) and guide tube (18 in FIG. 1) will take place.

Figure 2:
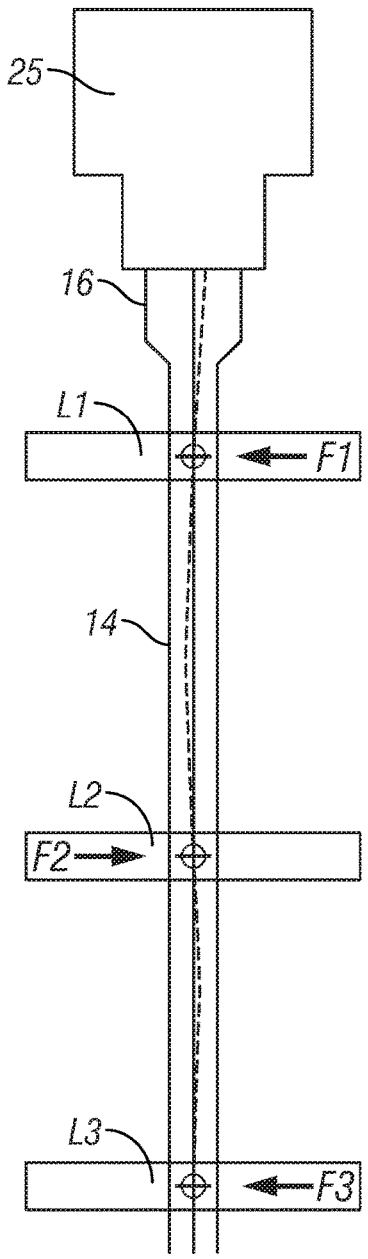
FIGS. 2, 3 and 4 schematically show lateral forces applied to a wellbore tubular component and transfer of such forces to the well support structure.
Figure 3:
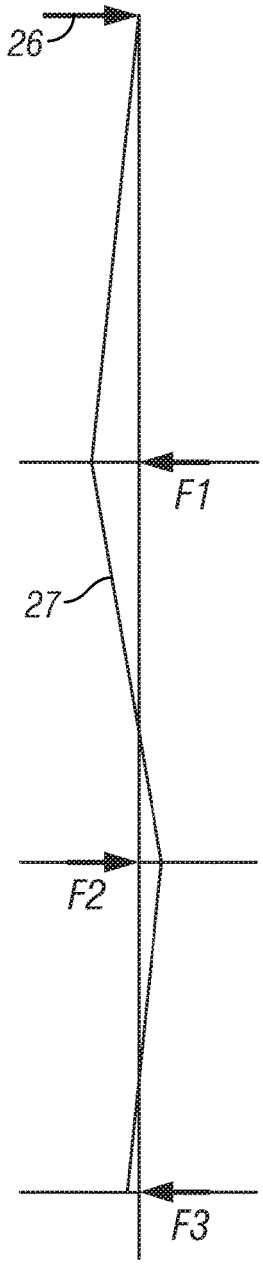

Referring to FIG. 2, which shows the well components, and FIG. 3 which shows lateral force magnitudes, the bending moment 27 caused by a horizontal force 26 (in FIG. 3) increases linearly from the point of attack, e.g., as applied to a well pressure control device 25 positioned above the first support level L1. Below the first support level L1 the reaction force F1 decreases the bending moment along the wellbore tubular component (14 in FIG. 2). The resulting bending moment distribution is shown as curve 27 in FIG. 3 with reaction forces F2 and F3 at each support level L2, L3 below the first support level L1

FIG. 4 shows the moments or loads at each support level, L1, L2, L3 of the embodiment shown in FIG. 1. 30 is the bending moment at the first support level (L1). 31 is the torsional moment Mt at the first support level L1. 32 is the vertical load (z-axis) at the first support level L1. 33 is the lateral (y-axis) load at the first support level L1. 34 is the lateral (x-axis) load at the first support level L1. 30A is the bending moment Mb at the second support level L2. 31A is the torsional moment Mt at the second support level L2. 32A is the vertical load (z-axis) at the second support level L2. 33A shows the lateral (y-axis) load at the second support level L2. 34A shows the lateral (x-axis) load at the second support level L2. 30B shows the bending moment Mb at the third support level L3. 31B is the torsional moment Mt at the third support level L3. 32B is the vertical load (z-axis) at the third support level L3. Lateral load (y-axis) is shown by 33B. Lateral load (x-axis) at the third support level L3 is shown at 34B.

In the embodiment shown in FIG. 1, the wellbore tubular component 14 may be fixed in place by partially or wholly filling the void space between the guide tube 18 and the wellbore tubular component 14 with a filling medium, for example wellbore cement 19. In some embodiments, the wellbore tubular component 14 may extend below the bottom of the well support base 10 as shown at 14A, or may be extendable during or after the installation process.

Figure 5:
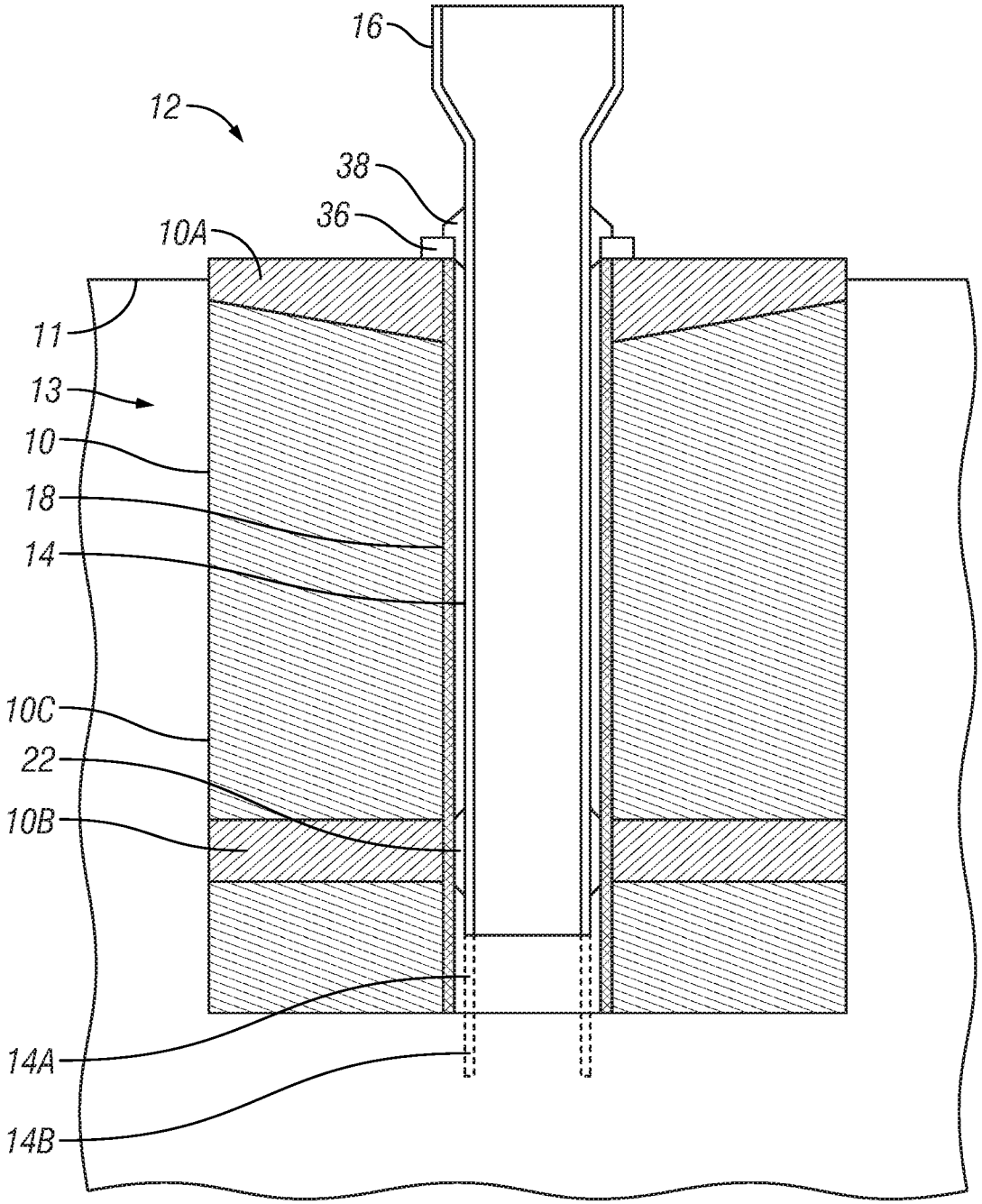
FIG. 5 shows other embodiments of a well support structure according to the present disclosure.

Another example embodiment is shown in FIG. 5. In the example embodiment of FIG. 5, a support sleeve 36 may be coupled into the well support base 10 at the first support level L1 at the top 10A of the well support base 10. A supporting element 38, which in the present example embodiment may be a ring, may be part of or fixed onto the wellbore tubular component 14. The supporting element 38 may be shaped to support at least part of the weight of the wellbore tubular component 14 when the wellbore tubular component 14 is lowered into the guide tube 18. Such support may be obtained by contact between a support sleeve 36 attached to the upper end of the guide tube 18 and the support ring 38. The contact between the support sleeve 36 and the support ring 38 is also capable of holding the wellbore tubular component 14 in place when the well structure (comprising the well support base 10 combined with the wellbore tubular component 14 using support sleeve 36 and support ring 38) is penetrated into the sediments 13 below the water bottom 11. Friction on the inside of the wellbore tubular component 14 may act to urge the wellbore tubular component 14 out of the well support base 10. The embodiment of FIG. 5 may comprise a centralizer 22 at the second support level L2 of at support 10B. In other embodiments, the wellbore tubular component may be affixed to the guide tube 18, for example, by welding.

Figure 6:
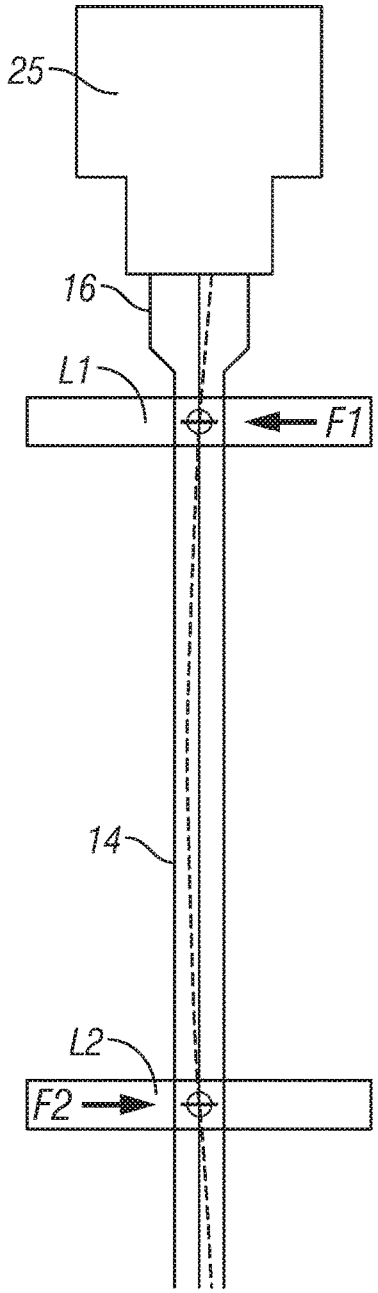
FIGS. 6 through 8 schematically show forces applied to a wellbore tubular component and transfer of such forces to the well support structure.

FIG. 6 shows the reaction forces F1, F2 at the top 10A of the well support base 10 and at the second support level L2 below the top 10A when a lateral force (26 in FIG. 7) is applied to a well component, e.g., a pressure control device 25. Other structures connected to the pressure control device 25 are omitted for clarity of the illustration.

Figure 8:
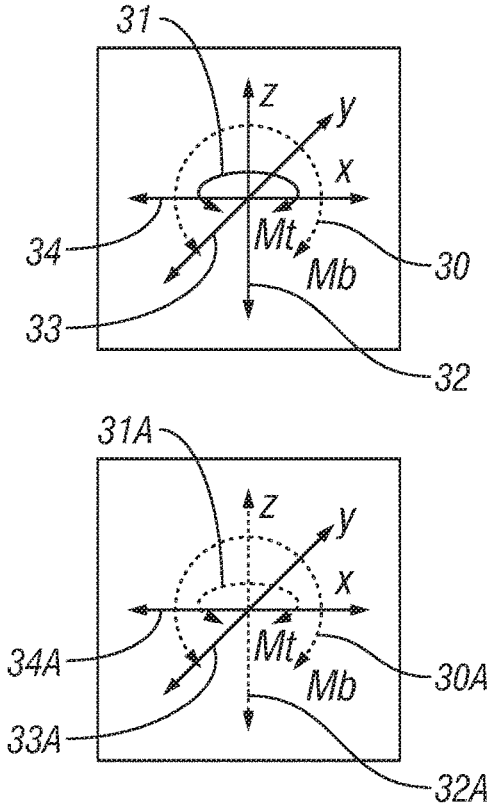

FIG. 8 shows that lateral stress on the wellbore tubular component 14 at the top 10A is resisted in both lateral directions 33, 34 as well as in the axial direction 32 while the wellbore tubular component 14 may be free to transfer rotational moment Mb 30 through the first support level L1. At the level of the centralizer 22, lateral stresses 33A and 34A are resisted by the centralizer 22, while axial stress 32A in the vertical direction and rotational bending moment 30A are not resisted or transferred to the guide tube 18.

Figure 7:
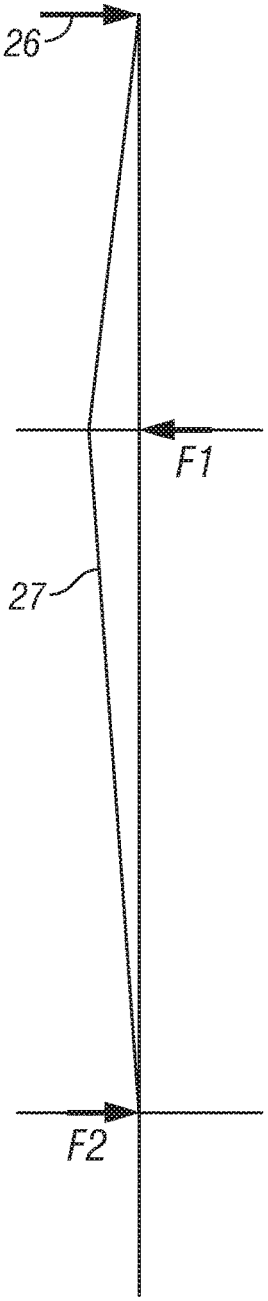

FIG. 7 shows a diagram of how a horizontal force 26 causes a bending moment distribution 27 in the wellbore tubular component 14. The bending moment Mb 30 is not transferred directly to the well support base 10 through the first support level L1 at the connection between the support ring (38 in FIG. 5) and the support sleeve (36 in FIG. 5) because such connection does not restrict rotational movements. Below the first support level L1 the bending moment is decreased by a reaction force F1.

FIG. 8 shows the moments or loads at each support level, L1, L2 of the embodiment shown in FIG. 5. 30 is the bending moment at the first support level L1. 31 represents the torsional moment Mt at the first support level L1. 32 is the vertical load (z-axis) at the first support level L1. 32 is the vertical (z-axis) load at the first support level L1. 33 is the lateral (y-axis) load at the first support level L1. 34 is the lateral (x-axis) load at the first support level L1. 30A is the bending moment Mb at the second support level L2. 31A is the torsional moment Mt at the second support level L2. 32A is the vertical load (z-axis) at the second support level L2. 33A shows the lateral (y-axis) load at the second support level L2. 34A shows the lateral (x-axis) load at the second support level L2.

The embodiment of FIG. 5 may provide one or more of the following benefits. No additional welding prevents hot spots and consequent induced stresses and reduction in structural integrity of base material and high grade (tempered) welds. By allowing free rotation at both support levels L1, L2 the overall stiffness of the system is reduced which may have the following effects: less stress concentration at the upper part of the wellbore tubular component, and therefore lower stresses in the wellbore tubular component 14 and thus also a higher fatigue life.

Additional benefits that may be provided by the embodiment of FIG. 5 may include that both support levels, L1, L2 experience only lateral loads (caused by the lateral load 26 as shown in FIG. 7) which simplifies the support structure design; connection at the first support level L1 (or any other level) may for example be performed by ROV connect/disconnect which may allow simple assembly of components, simple disassembly of components, lower component weight during installation and recovery of components, no need to cut conductor casing and cement during well plug and abandonment procedures but only the wellbore casing string installed after the wellbore component 14 (e.g., 20 of 13⅜ inch diameter casing) needs to be cut. It also allows for well growth cause by temperature increases during the production phase of a well.

Figure 9:
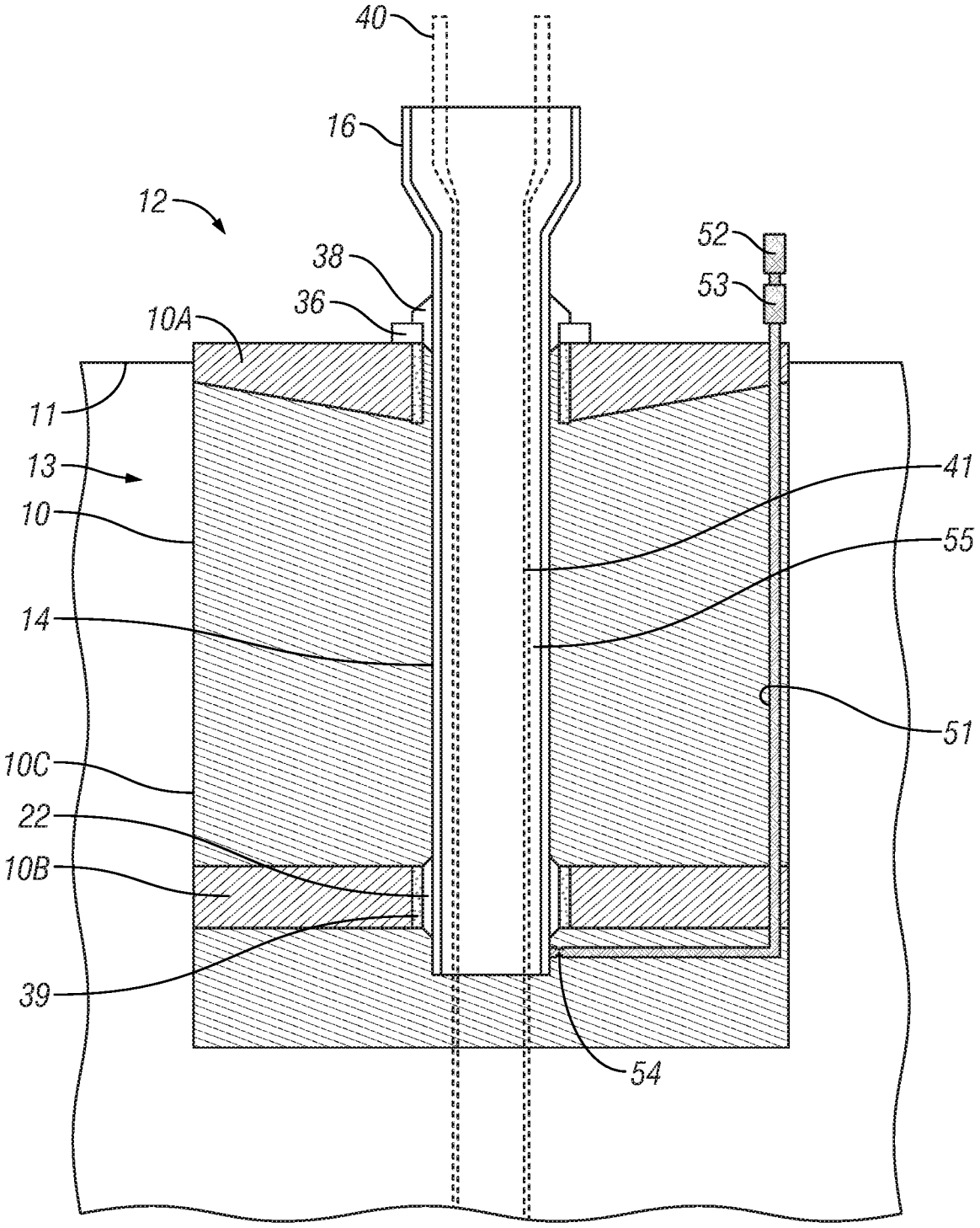
FIG. 9 shows another embodiment similar in structure to the embodiment shown in FIG. 5, wherein the guide tube in FIG. 5 is omitted.

FIG. 9 shows another example embodiment of a well support structure that is similar to the embodiment shown in FIG. 5. The difference between the embodiment shown in FIG. 5 and the embodiment shown in FIG. 9 is that the guide tube (18 in FIG. 5) is omitted from the embodiment shown in FIG. 9. The embodiment in FIG. 9 may include a centralizer 22 on the wellbore tubular component 14 at the second support level L2, and a load transfer ring 39 disposed between the second support 10B and the centralizer 22. Load transfer at the top 10A may be obtained using a support sleeve 36 and a supporting element 38 as in the embodiment of FIG. 5. In some embodiments, the centralizer 22 or other load transfer device may be omitted, and the wellbore tubular component 14 may be coupled directly to the lower support 10B, for example, by welding.

In some embodiments, the well support structure may include filling media top-up line components, for example as shown at 51, 52, 53, 54. An annulus 55 between the wellbore tubular component 14 and a wellbore tubular element 41 (for example and without limitation a surface casing) may be topped up with a filling medium in using the filling top-up line 51. A filling medium top-up connection 52 can be used to connect a filling medium source (e.g., a drill string, an ROV pump, etc.) to the filling medium top-up line 51. A valve 53 allows opening and closing the filling medium top-up line 51. The foregoing components may be especially helpful in the case where the wellbore tubular component 14 is installed together with the supporting structure and the wellbore tubular element 41 is installed by a drilling vessel. During the cementing of wellbore tubular element 41 by the drilling vessel it often occurs that the filling medium (e.g., cement) sags due to temperature changes and possible leaks in a float shoe (not shown) at the bottom end of wellbore tubular element 41. Cement shortfall between the wellbore tubular component 14 and the wellbore tubular element 41 can lead to reduced fatigue life. The above described filling media top-up components 51 through 54 can also be utilized as filling media diverter lines to prevent filling media from reaching the upper part of the well component to protect e.g., sealing areas at the upper end of e.g., the wellbore tubular component 14 and wellbore tubular upper end 40. For this purpose the connection of the top-up line 51, possibly using a predetermined load break point 54, to the wellbore tubular component 14 may be located higher toward the first support level (L1 in FIG. 10) of the first support 10A. Such an application may also enable back-flushing through elements 51 through 54 with a cleaning agent, e.g., sea water, to clean the upper end of the wellbore elements (e.g., upper end of wellbore tubular component 16 and 40) from filling medium.

To allow decoupling the wellbore tubular component 14 from the support structure by releasing the connection between support sleeve 36 and supporting element 38, the predetermined load break point 54 may be installed into the filling medium top-up line 51. The predetermined load break point 54 may be configured to rupture at a predetermined tensile or shear load, thereby enabling subsequent movement of the wellbore tubular component 14 from the support structure 10. In some embodiments the connection between the filling medium top-up line 51 and the wellbore tubular component 14 can be established by a passage through a centralizer receptacle 39 and the centralizer 22. If the wellbore tubular component 14 is installed independently (e.g., after) of the well support structure 10 the wellbore tubular component 14 may be equipped with an alignment device that ensures that the interior of the wellbore tubular component 14 is aligned with the passage through the centralizer 22 and the centralizer receptacle 39 so that communication with the filling medium top-up line 51 is established.

Figure 10:
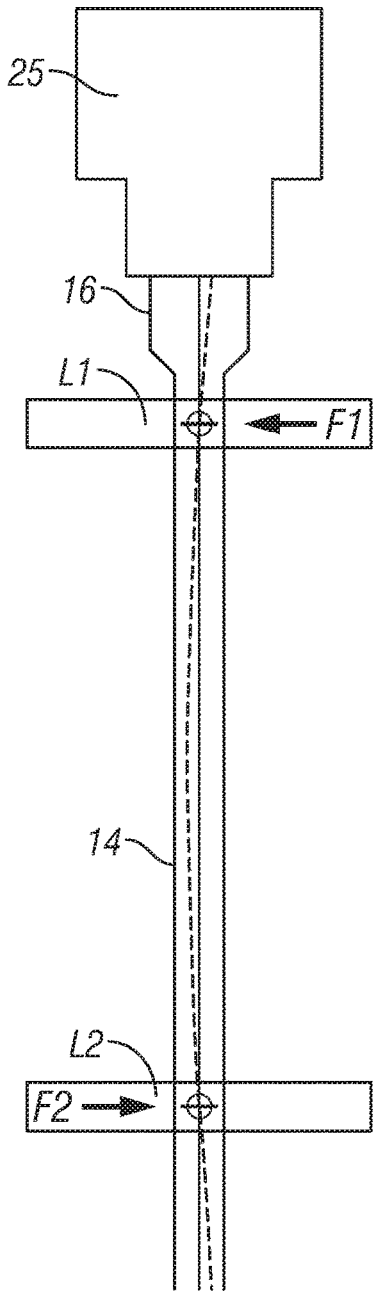
FIGS. 10 through 12 show forces and force distributions similar to those shown for the embodiment of FIG. 5, and such figures correspond to FIGS. 6 through 8, respectively.

The upper end of the wellbore tubular 41 may comprise a high pressure housing 40, which may itself be coupled to a well pressure control device (see element 25 in FIG. 10).

Figure 11:
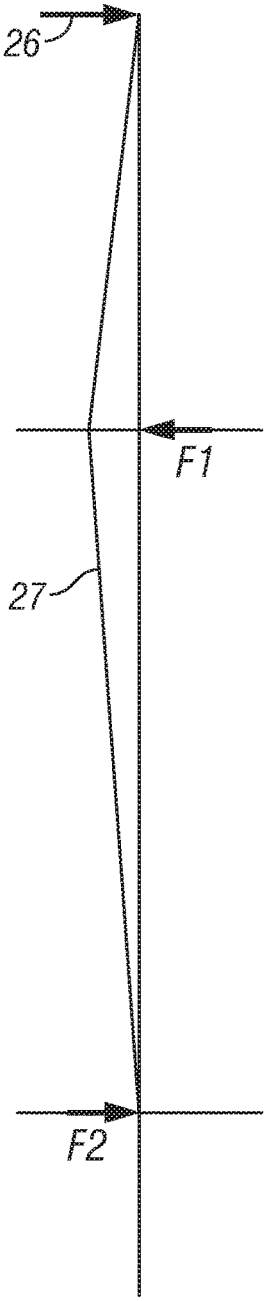
Figure 12:
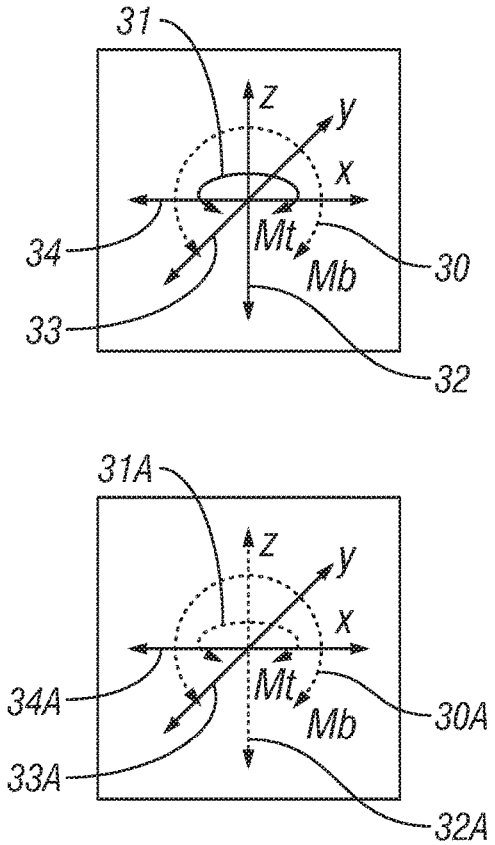

FIGS. 10-12 show, respectively, forces, force distributions and moments substantially as shown in FIGS. 6-8.

Figure 13:
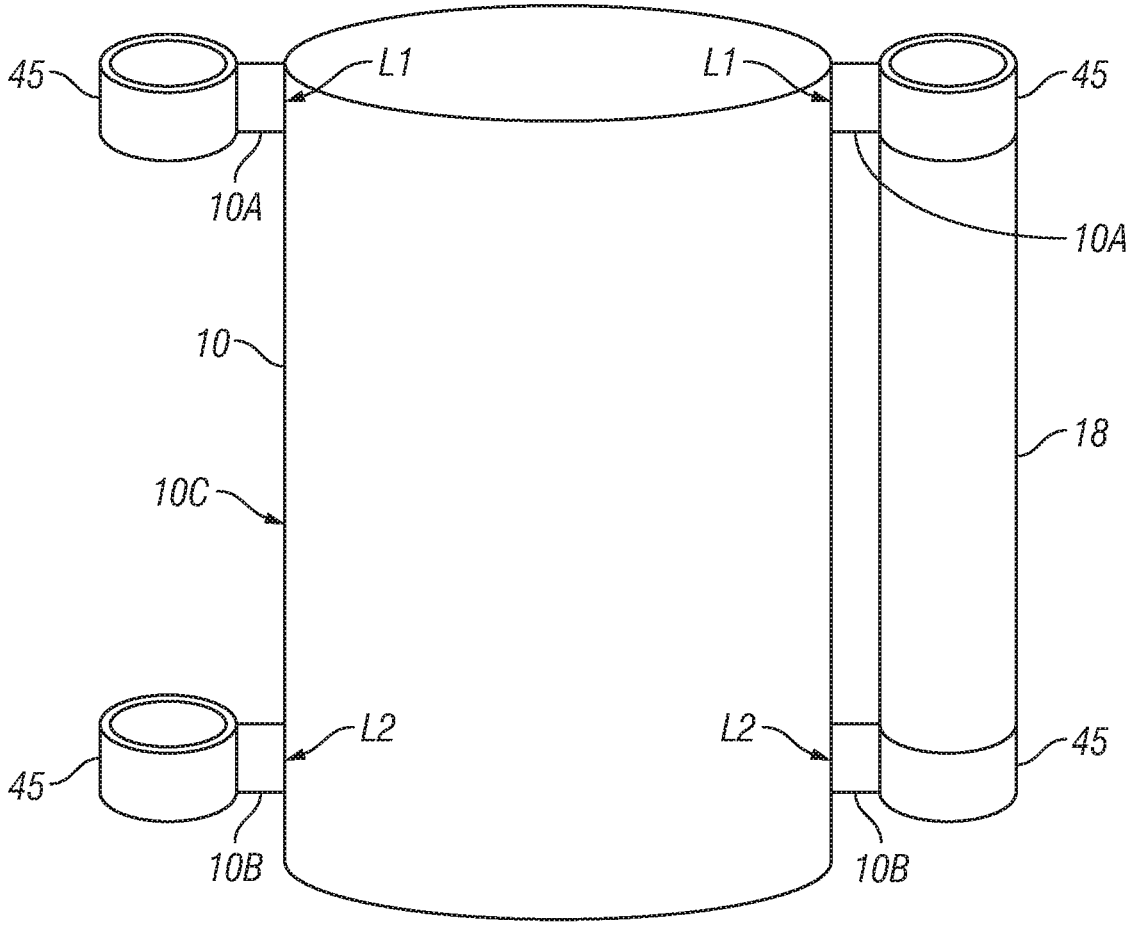
FIG. 13 shows another embodiment of a well support structure.

FIG. 13 shows another embodiment of a well support structure. A well support base 10 may be any structure that is intended to at least partially penetrate sediments below the water bottom or provide the required support by other means (such as gravity based high weight, or foundation structures that are fixed to the water bottom by suitable means such as driven piles) as explained with reference to the embodiment in FIG. 1 and FIG. 5. The well support base 10 may have one or more first supports 10A connected to the well support base 10 proximate the top of the well support base 10. However, in the present example embodiment, the first support(s) 10A may be coupled to an exterior of the well support base 10. The first support(s) 10A may be disposed at a first support level L1. The first support(s) 10A may have a load transfer collar 45 connected to each of the first support(s) 10A. Load transfer between the wellbore tubular component (14 in FIG. 1) and the first supports (10A) may be obtained using any of the embodiments described herein. In the present embodiment, second load support(s) 10B may be disposed at a second support level L2. The second load support(s) 10B may comprise a load transfer collar 45 coupled to each second load support 10B. Load transfer between the wellbore tubular component (14 in FIG. 1) and the load transfer collar 45 may be obtained using any of the embodiments described herein. In the embodiment of FIG. 13, a guide tube 18 may be used or may be omitted. Although not shown in FIG. 13, the support base 10 may also include supports as shown in FIGS. 1 and 5, wherein the wellbore tubular component is supported within a space defined within the exterior wall of the well support base 10.

Figure 14:
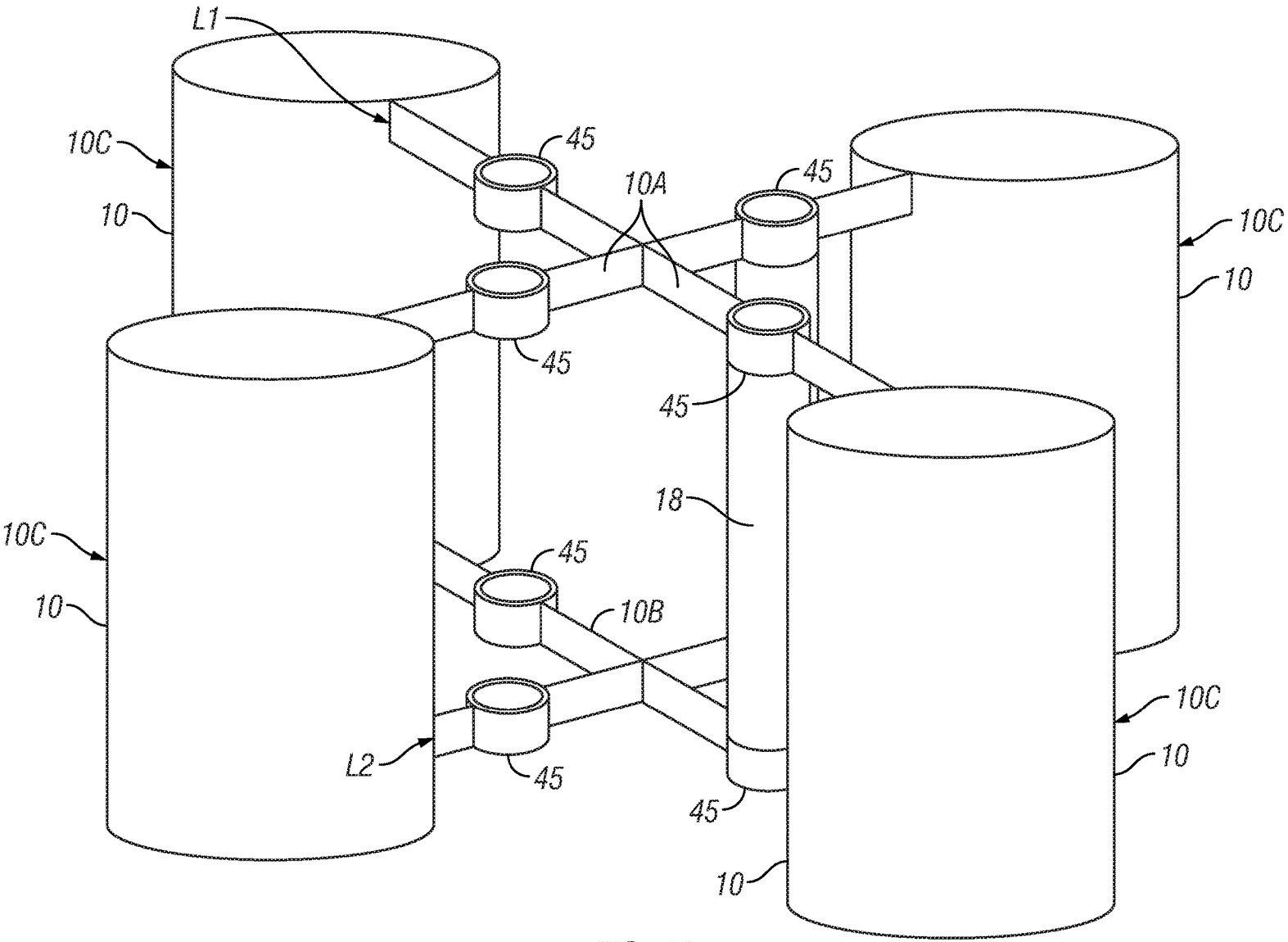
FIG. 14 shows another embodiment of a well support structure.

FIG. 14 shows another embodiment comprising a plurality of interconnected well support bases 10, first supports 10A connected to an exterior of the well support bases 10 at a first support level L1 in any geometric arrangement selected. A same geometric arrangement of second supports 10B at a second support level L2 may be provided. The first supports 10A and second supports 10B may have load transfer collars 45 disposed at the positions where a wellbore tubular component (14 in FIG. 1 and FIG. 5) may be desired to be placed. Load transfer between the wellbore tubular component (14 in FIG. 1 and FIG. 5) may be obtained using any of the structures explained with reference to FIG. 1 or FIG. 5. In some embodiments, guide tubes 18 may extend between any or all of the upper supports 10A and lower supports 10B, or may be omitted entirely. Although not shown in FIG. 13, the support base 10 may also include supports as shown in FIGS. 1 and 5, wherein the wellbore tubular component is supported within a space defined within the exterior wall of the well support base 10.

Figure 15:
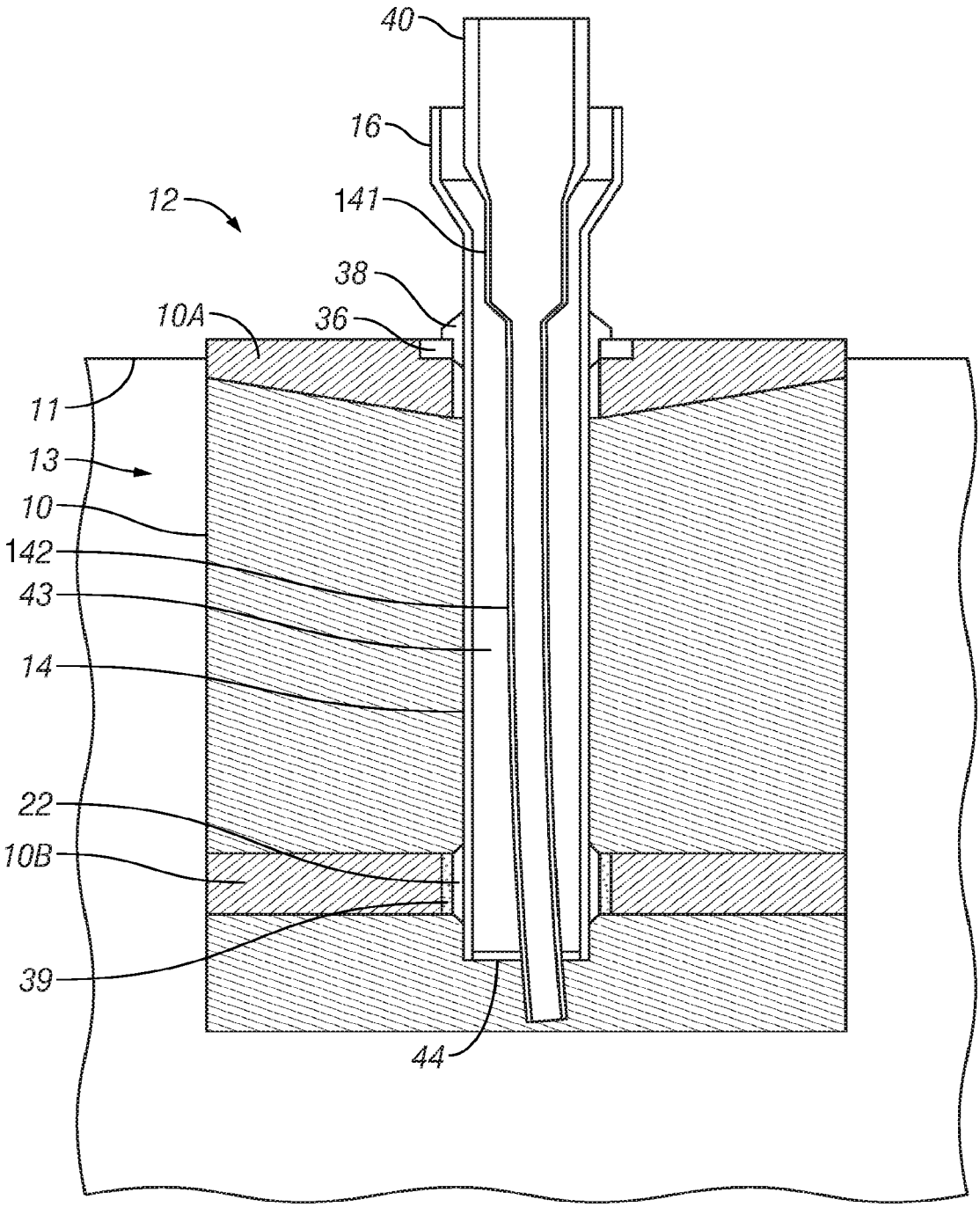
FIG. 15 shows another embodiment of a well support structure.

FIG. 15 shows another embodiment of a well support structure that may be used in connection with construction of highly inclined wellbores. The embodiment shown in FIG. 15 may comprise all the components shown in and described with reference to FIG. 9. In addition, the embodiment shown in FIG. 15 may include a high pressure housing 40, a diameter reduction section 141 and a curved wellbore tubular component 142 having a diameter selected to fit within the wellbore tubular component 14 explained with reference to FIG. 9. The curved wellbore tubular component 142 may exit the bottom of the well support base 10 through a template 44. The foregoing components may be pre-assembled to the well tubular component, e.g., and without limitation by including a filler material 43 such as wellbore cement. The assembled components including the wellbore tubular component 14 may be preassembled to the well support structure or may be assembled to the well support structure at the well site.

Figure 16:
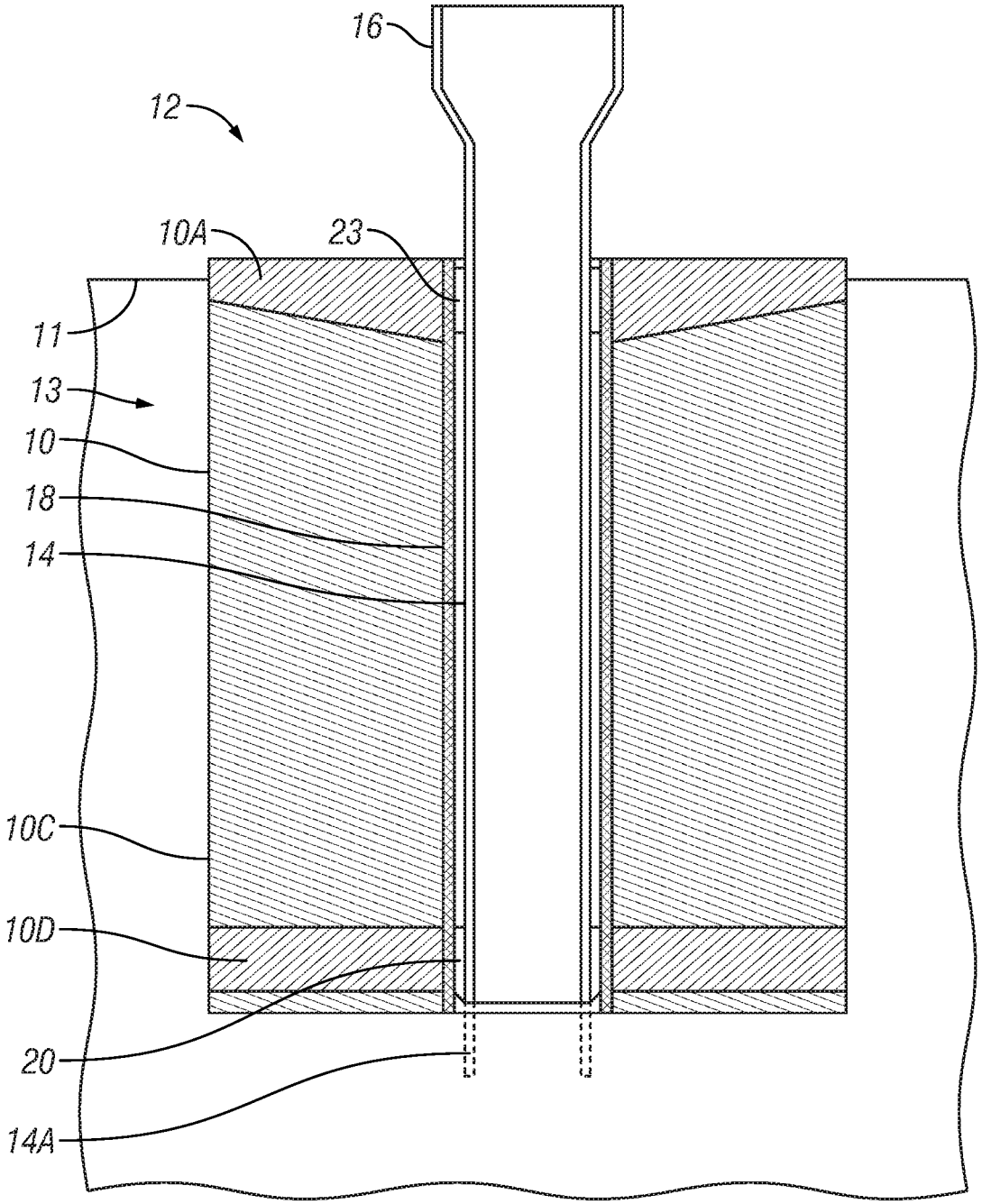
FIG. 16 shows another embodiment of a well support structure.

FIG. 16 shows another example embodiment similar in structure to the embodiment shown in FIG. 1, with the following noted differences. The second support level of the embodiment in FIG. 1 (10B in FIG. 1) may be omitted as well as the centralizer (22A in FIG. 1) associated with the second support level of FIG. 1. Structure at what is the longitudinal position of the third support level of FIG. 1 (10D in FIG. 1) may be similar to the structure shown in FIG. 1. The anchor 20 may be similar to the structure described with reference to FIG. 1. The centralizer (22 in FIG. 1) at the first support level 10A may be substituted by a resilient element 23, for example an elastomer annular ring disposed in the space between the wellbore tubular 14 and the guide pipe (18 in FIG. 1). The resilient element 23 may be used at any support level and in any possible combination with any other means of fixation as described with reference to the other embodiments disclosed herein.

Figure 17:
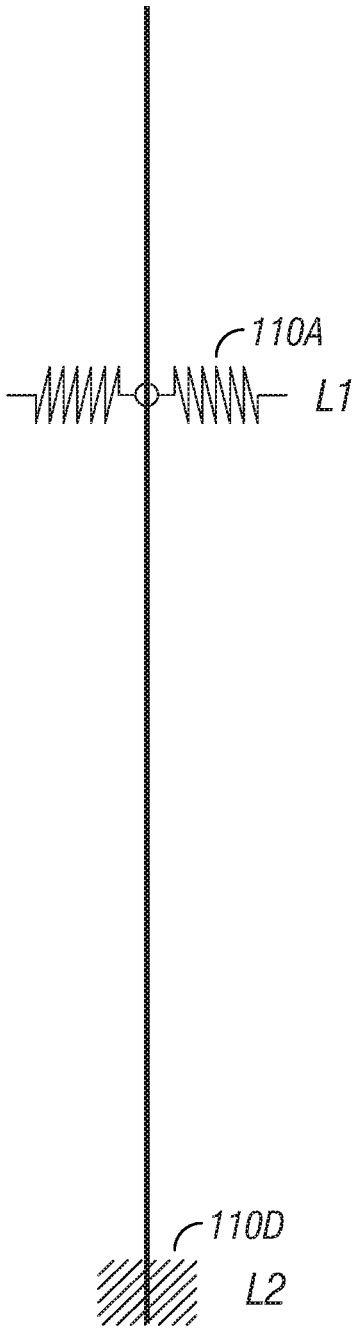
FIG. 17 shows an equivalent mechanical analog to the example embodiment shown in FIG. 16.

A mechanical analog structure to the embodiment shown in FIG. 16 is shown in FIG. 17, wherein the conductor anchor (20 in FIG. 16) is represented as a solid, inflexible connection 110D at a second support level L2 (corresponding in longitudinal position to the third support level in FIG. 1) and the resilient element (23 in FIG. 16) is shown as a spring or similar biasing device 110A at the first support level L1.

Figure 18:
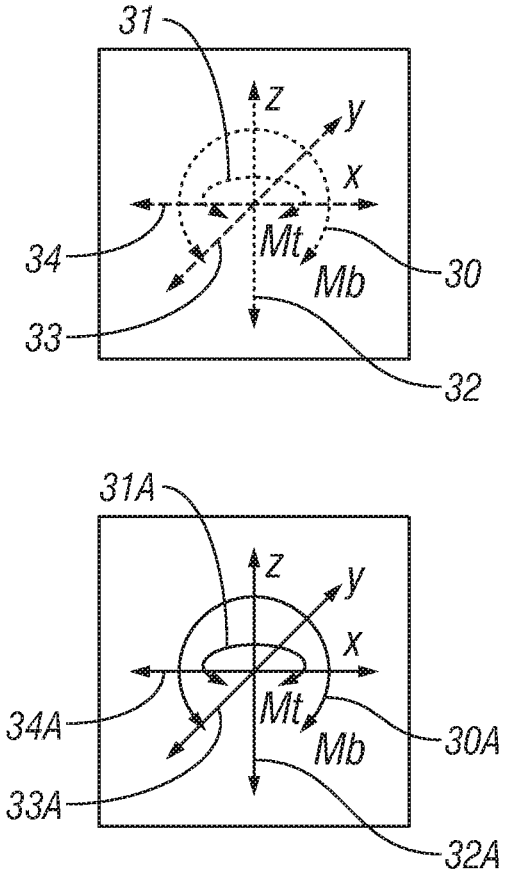
FIG. 18 shows forces and force distributions for the embodiment shown in FIG. 16.

FIG. 18 shows the moments or loads at each support level, L1, L2 of the embodiment shown in FIG. 16. 30 is the bending moment at the first support level L1. 31 represents the torsional moment Mt at the first support level L1. 32 is the vertical load (z-axis) at the first support level L1. 33 is the lateral (y-axis) load at the first support level L1. 34 is the lateral (x-axis) load at the first support level L1. 30A is the bending moment (load) Mb at the second support level L2. 31A is the torsional moment Mt at the second support level L2. 32A is the vertical load (z-axis) at the second support level L2. 33A shows the lateral (y-axis) load at the second support level L2. 34A shows the lateral (x-axis) load at the second support level 2.

In some embodiments, at least one support level may be activated (during time when loads are to be expected, e.g., while drilling the well) and/or deactivated (during times when no loads are expected, e.g., while the well is producing), for example by using a remotely operated vehicle (ROV) or other remotely operable means. Structures that may enable such feature include for example that the resilient element (23 in FIG. 16) may in some embodiments be an inflatable annular packer or a rubber packer that is activated by axial compression (in direction of 32 (z-axis) of FIG. 18) of the rubber, thus expanding laterally (in direction of 33 (y-axis) and 34 (x-axis) of FIG. 18) and supporting the wellbore component 14 of FIG. 18.

In some embodiments, it may be desirable for the coupling at any support level to allow some axial movement. An example embodiment of such feature may comprise a resilient element, such as shown at 23 in FIG. 16 that has elastomer supports activated by compressing them axially using, for example, bolts that extend along the longitudinal dimension of the elastomer support. The elastomer support may be stiffened by tightening the bolts so as to compress the elastomer support. Therefore the construction can also be deactivated by releasing the compression when the bolts are loosened. The foregoing elastomer support may be operable by an ROV, but other mechanical/hydraulic/etc. devices to activate and deactivate the elastomer will readily occur to those skilled in the art that can be used to activate/deactivate such elastomer support disposed at any support level. It will be appreciated by those skilled in the art that if resilient (e.g., elastomer) elements at both support levels of a two level supported pipe then the following conditions may exist. The wellbore tubular, e.g., 14 in FIG. 16 is laterally supported at both the first level L1 and the second support level L2 are laterally supported by the resilient elements. For high axial loads the wellbore tubular 14 may rest on a ring at the bottom of the guide pipe (e.g., 18 in FIG. 1). Friction between the elastomer and the wellbore tubular 14 also provides some load capacity in the vertical (z-axis) direction. This is important when the well support structure is installed into the seabed. There will be seabed soil in the inside of the wellbore tubular 14. As the wellbore tubular 14 moves downward, the friction to the soil will resist further downward motion of the wellbore tubular 14. From the frame of reference of the support base 10 it appears as if the wellbore tubular 14 is pulled out of the support base 10. The friction with the seabed soil is limited and it is undesirable to move the wellbore tubular 14 in this situation.

Extending the foregoing analysis from installation of the well support structure to where a subsea well has been drilled and completed and it is set into production, produced sub-bottom reservoir fluids have higher temperature than sea water proximate the sea floor and will warm up the steel and cause the steel to expand. This thermal expansion is called "well growth" in the oil and gas industry. The forces due to thermal expansion may be higher than the shear forces generated during installation of the well support structure where the soil tries to "push the wellbore tubular out of the support base." In this situation the axial support capacity of elastomer support elements is not high enough to restrict the movement, therefore the well tubular will move upwards. For cases where it is not desirable to have lateral movement between the centralizer 23 and the wellbore tubular component 14, the centralizer 23 may be integrated into the support structure 10 in a way that allows vertical movement, e.g., a sliding sleeve (not shown in any figure). These movements may be in the 100 mm range for normal temperature wells, and up to 300 mm for high temperature wells. In such situation it may be desirable to configure the resilient element (e.g., elastomer) to provide that at least one supporting level is constructed in a manner that allows axial forces to be restricted up to a selected or predetermined threshold, but will allow the wellbore element to slip above said threshold. In some embodiments, the resilient element may be constructed in a way that allows the deactivation of the element as described earlier.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A well support structure, comprising:

a well support base for urging below a bottom of a body of water;

a first wellbore tubular component supported by the well support base, wherein the first wellbore tubular component is not integrally formed with the well support base;

a second wellbore tubular component nested within the first wellbore component;

a filling medium top up line in fluid communication with a space defined between an interior of the first wellbore tubular component and an exterior of the second wellbore tubular component, the filling medium top up line arranged to enable movement of filling medium into the space to fill the space.

2. The structure of claim 1 wherein the first wellbore tubular component comprises a surface casing.

3. The structure of claim 1 wherein the first wellbore tubular component comprises a conductor casing.

4. The structure of claim 1 further comprising a predetermined load break point disposed in the filling medium top up line configured to rupture at a predetermined axial load or shear load, such that rupture of the predetermined load break point enables movement of the wellbore tubular component with respect to the well support base.

5. The structure of claim 1 wherein the filling medium top up line extends through a lateral support extending between the well support base and the first wellbore tubular component.

6. The structure of claim 1 wherein the filling medium top up line comprises a valve therein, wherein the valve is arranged to open or close the filling medium top up line to fluid passage therethrough.

7. The structure of claim 1 wherein the interior space is further defined by an exterior of a second wellbore tubular component disposed inside the first wellbore tubular component.

8. The structure of claim 1 wherein the second wellbore tubular component comprises a surface casing and the first wellbore tubular component comprises a conductor casing.

9. A method for well construction, comprising:

disposing a first wellbore tubular component through a well support base extending through a bottom of a body of water, wherein the first wellbore tubular component is not integrally formed with the well support base;

nesting a second wellbore tubular component within the first wellbore tubular component; and filling a space defined by an interior of the first wellbore tubular component and an exterior of the second wellbore tubular component with a filling medium, the filling performed at least in part through a filling medium top up line in fluid communication with the space.

10. The method of claim 9 wherein the filling medium comprises cement, and wherein the interior space is further defined by an exterior of a second wellbore tubular component disposed inside the wellbore tubular component.

11. The method of claim 9 further comprising applying axial force to the filling medium top up line to as to rupture the filling medium top up line at a predetermined axial force.

12. The method of claim 11 further comprising moving the first wellbore tubular component after rupturing the filling medium top up line.

13. The method of claim 9 further comprising flushing the space by pumping a cleaning agent through the filling medium top up line.

* * * * *